US006293346B1

(12) United States Patent
Patel

(10) Patent No.: US 6,293,346 B1
(45) Date of Patent: Sep. 25, 2001

(54) METHOD AND APPARATUS FOR RELIEVING PRESSURE

(75) Inventor: Dinesh R. Patel, Surgar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/396,006

(22) Filed: Sep. 15, 1999

Related U.S. Application Data

(60) Provisional application No. 60/101,206, filed on Sep. 21, 1998.

(51) Int. Cl.[7] ..... E21B 34/08

(52) U.S. Cl. ..... 166/373; 166/386; 166/169; 166/165; 166/166; 166/324; 166/317

(58) Field of Search ..... 166/163, 164, 166/165, 166, 842.1, 317, 324, 373, 376, 386

(56) References Cited

U.S. PATENT DOCUMENTS

| | | | | |
|---|---|---|---|---|
| 4,427,070 | * | 1/1984 | O'Brien | 166/317 |
| 4,911,242 | | 3/1990 | Hromas et al. . | |
| 4,971,365 | | 11/1990 | Schultz . | |
| 5,188,183 | | 2/1993 | Hopmann et al. . | |
| 5,316,086 | * | 5/1994 | DeMoss | 166/373 |
| 5,947,206 | * | 9/1999 | McCalvin et al. | 166/324 |
| 6,109,356 | * | 8/2000 | Echols et al. | 166/386 |

FOREIGN PATENT DOCUMENTS

WO 00/17483 3/2000 (WO) .

* cited by examiner

*Primary Examiner*—David Bagnell
*Assistant Examiner*—Jennifer R. Dougherty
(74) *Attorney, Agent, or Firm*—Trip, Pruner & Hu PC

(57) ABSTRACT

A pressure relief system includes a closed space having fluid trapped therein, a chamber defined in the closed space, and a pressure responsive member for controlling fluid flow from the closed space to the chamber. Fluid flows from the closed space to the chamber when the pressure in the closed space exceeds a predetermined pressure.

39 Claims, 6 Drawing Sheets

(A-A)

METHOD AND APPARATUS FOR RELIEVING PRESSURE

This application claims the benefit of U.S. Provisional Application Ser. No. 60/101,206 filed on Sep. 21, 1998.

BACKGROUND OF THE INVENTION

1. Technical Field

The invention relates generally to pressure relief systems and, more particularly, to a method and apparatus for relieving pressure in a pressurized space between two casings, or other members, in a well.

2. Background Art

Drilling of a well through subsurface formations typically involves progressively running casings into the well. Normally, the well is drilled to an initial depth and a conductor casing is run into the well and cemented to the well. A wellhead is typically mounted on the upper end of the conductor casing to provide means for suspending additional casings in the well. The rest of the well is drilled in sections with an intermediate casing run into the well after drilling of each section. The intermediate casings are concentrically arranged in the well with the innermost casing having the smallest diameter among all the casings and extending to a desired well depth, typically near a production zone. FIG. 1 shows a conductor casing 10 that is secured in a well 12 by a cement sheath 14. Intermediate casings 16 and an innermost or production casing 18 are suspended in the well 12. As shown, adjacent casings and the surrounding formation define annular spaces 20. The annular spaces 20 are sealed at the top by the wellhead 22 and closed at the bottom by the formation.

The well is drilled by lowering an appropriately sized drill bit on the end of a drill string into the well and operating the drill bit to cut the formation. While operating the drill bit, drilling fluid is pumped through the drill string to move the earth cuttings away from the bottom of the well to the surface. The drilling fluid in the well also serves to control formation fluid influx into the well. The casings are run into the well with the drilling fluid in the well so that the drilling fluid is trapped in the annular spaces 20 between the casings. Typically, cement is pumped into the annular spaces 20 to displace the drilling fluid, secure the casings to the well, and prevent formation fluid influx into the annular spaces 20. As can be appreciated, for casings extending several hundred feet into the well, substantial volumes of cement are required to fill the annular spaces. Thus, from an economic standpoint, it would be desirable to not displace the drilling fluid in the annular spaces with cement or to partially fill the annular spaces with cement, preferably the bottom portions of the annular spaces that are exposed to the surrounding formations.

The well is put to production after it is completed. Completion of the well may include suspending a liner 24 near the bottom end of the production casing 18. The liner 24 includes perforations through which formation fluid may enter the liner 24 and flow into a production tubing 26. A packer 28 isolates the section of the well to be produced by sealing an annular space between the production tubing 26 and the production casing 18. During production, if drilling fluid is trapped in any one of the annular spaces 20, the temperature of the drilling fluid trapped in the annular space rises to the temperature of the flowing formation fluids, resulting in expansion of the trapped drilling fluid. Because the annular space is closed, the pressure of the expanding drilling fluid also rises. When the pressure of the trapped drilling fluid exceeds the fracture pressure of the surrounding formation, the drilling fluid is forced into the formation adjacent the annular space and the pressure in the annular space stops rising. However, if the formation is plugged for some reason such that the fluid is unable to enter the formation, the fluid pressure in the annular space will continue to rise and may eventually cause the casings to burst or collapse. The formation may be plugged because it is cemented off. Even if the formation is not cemented off, the formation may still be plugged if the drilling fluid in the annular space is weighted with solids and the solids fall down and accumulate in the annular space as the temperature of the drilling fluid in the annular space rises.

It is undesirable to have the casings burst since this will lead to loss in control of the well. Thus, it has been the typical practice to completely fill the annular spaces with cement so that the pressure rise due to thermal expansion of trapped drilling fluid in the annular spaces is eliminated. However, for economical reasons, it is desirable to be able to produce the well with the annular spaces unfilled or partially filled with cement. One way of accomplishing this feat is to make the casings strong enough to withstand pressure increases that may occur due to thermal expansion of trapped drilling fluid in the annular spaces. This generally means heavier and more expensive casings, along with more expensive equipment for running the casings into the well, and may not result in cost savings over the typical practice of filling the annular spaces with cement.

Another method for preventing casings from bursting when the drilling fluid trapped in the annular spaces expands is to run a pressure relief valve between the casings. For example, a pressure relief valve may be run on the production casing such that fluid transfer from the annular spaces to the production casing occurs. The fluid in the production casing is maintained at a desired pressure and the pressure relief valve operates to equalize the pressure in the annular spaces with the pressure in the production casing. However, with the equalizing of pressure comes mixing of fluid in the annular spaces with the fluid in the production casing. This mixing of fluids, e.g., drilling fluid and completion fluid, may be undesirable. The drilling fluid in the annular spaces may contain solids which can accumulate in the production casing and settle on the packer 28. Also, if the pressure relief valve seal fails, a leak path is created between the casings, creating a potential for uncontrolled fluid transfer between the casings.

SUMMARY OF THE INVENTION

In general, in one aspect, a pressure relief system comprises a closed space having fluid trapped therein and a chamber defined in the closed space. A pressure responsive member controls fluid flow from the closed space to the chamber. Fluid flows from the closed space to the chamber when the pressure in the closed space exceeds a first predetermined pressure.

In general, in another aspect, a method for relieving pressure in a closed space having fluid trapped therein comprises providing a chamber in the closed space for receiving fluid from the closed space and providing a pressure responsive member for controlling fluid communication between the closed space and the chamber.

Other advantages of the invention will become apparent from the following description and from the appended claims.

DETAILED DESCRIPTION

Figure 1:
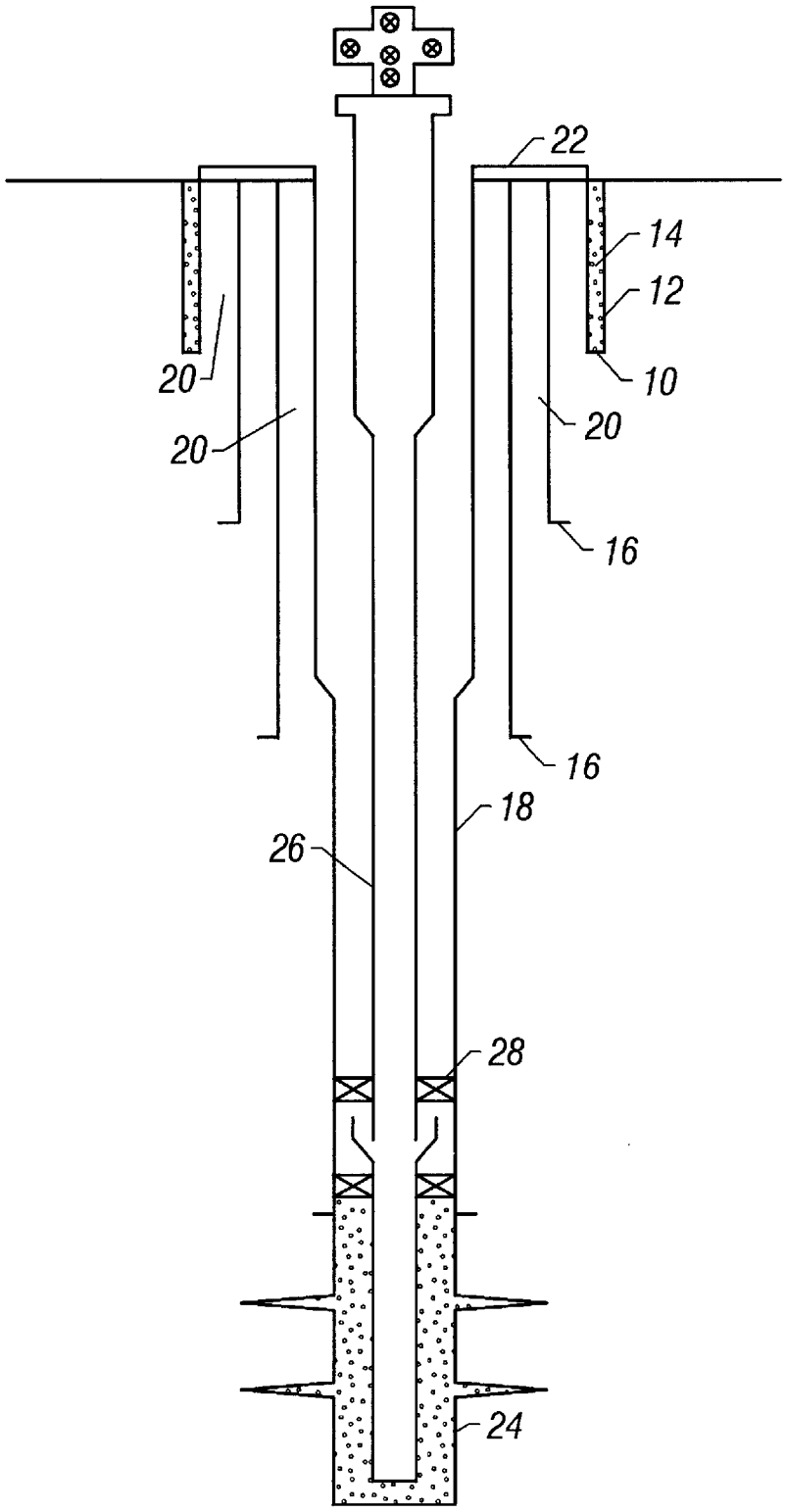
FIG. 1 (Prior Art)
FIG. 1 is a cross-sectional view of a cased well.
Figure 2:
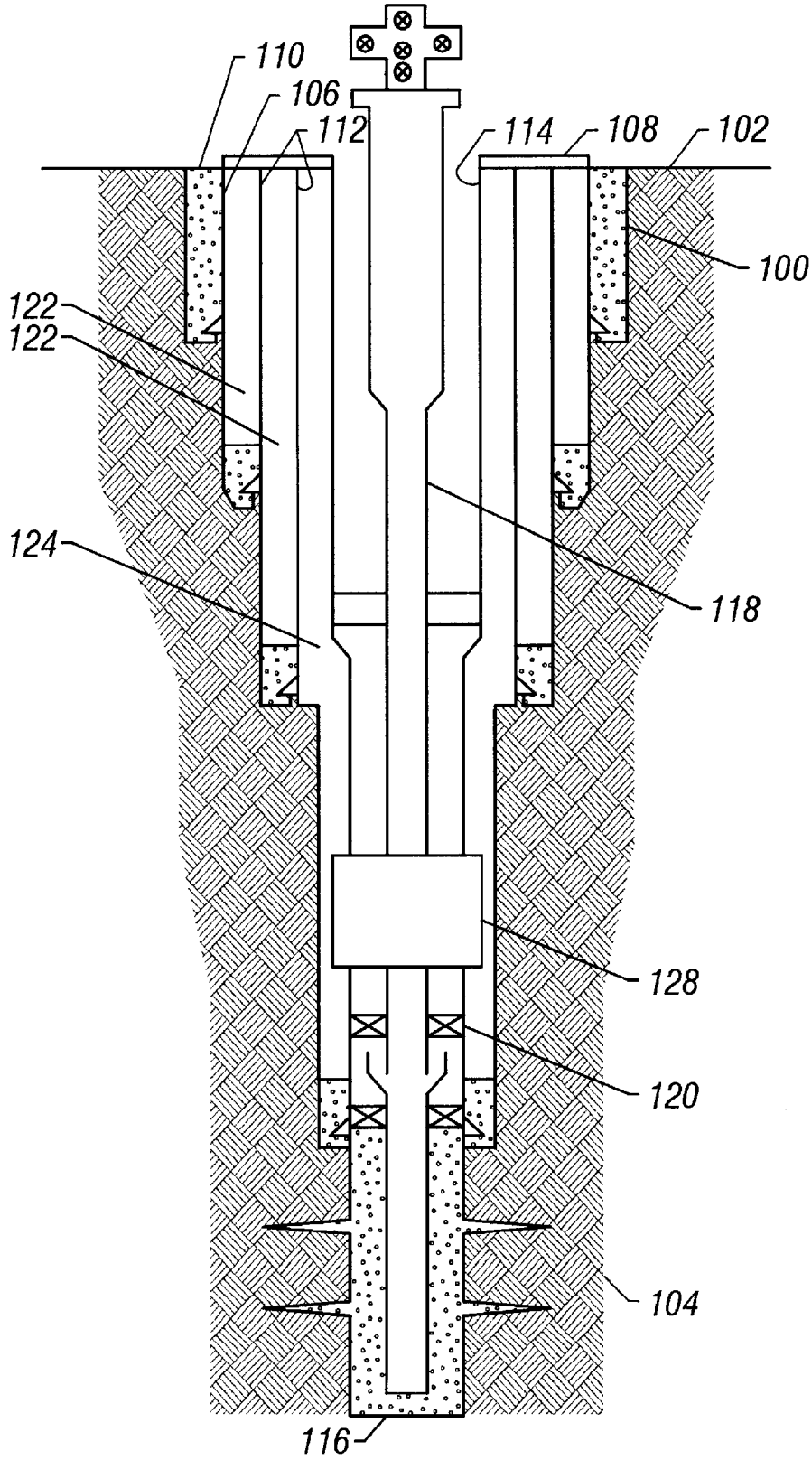
FIG. 2 is a partial cross-sectional view of a cased well with a pressure relief device mounted on a casing.

Referring to the drawings wherein like characters are used for like parts throughout the several views, FIG. 2 depicts a well 100 extending from a surface 102 through a production zone 104. A conductor casing 106 extends from the surface 102 into the well 100. The conductor casing 106 is secured to the well 100 by a cement sheath 110. A wellhead 108 is mounted on the conductor casing 106. The wellhead 108 includes hangers for suspending additional casings in the well 100. Intermediate casings 112 and a production casing 114 are hung off the wellhead 108 and suspended in the well 100. A liner 116 disposed inside the well includes perforations which allow formation fluids from the production zone 104 to flow into the liner 116. The formation fluid flowing into the liner 116 is directed into a production tubing 118 that is suspended in the production casing 114. Packers 120 are positioned between the production casing 114 and the production tubing 118 and liner 116 to isolate the section of the well 100 which lies adjacent the production zone 104.

The intermediate casings 112 and the production casing 114 are concentrically arranged in the well 100 such that annular spaces 122 and 124 are defined between adjacent casings. The bottom ends of the casings are secured to the well by cement. When the casings 112 and 114 are run into the well and set in place, drilling fluid fills and remains trapped in the annular spaces 122 and 124. A pressure relief device 128 is disposed in the annular space 124. The pressure relief device 128 includes a fluid dump chamber which receives excess fluid from the annular space 124 as the fluid trapped in the annular space 124 expands and pressure in the annular space rises above a predetermined level. The expected fluid volume increase in the annular space 124 due to thermal expansion is calculated by knowing the fluid volume in the annular space 124, the temperature gradient, and the expected temperature increase due to formation fluid flow. The volume of the fluid dump chamber is designed to be larger than the expected volume increase due to thermal expansion.

Figure 3A:
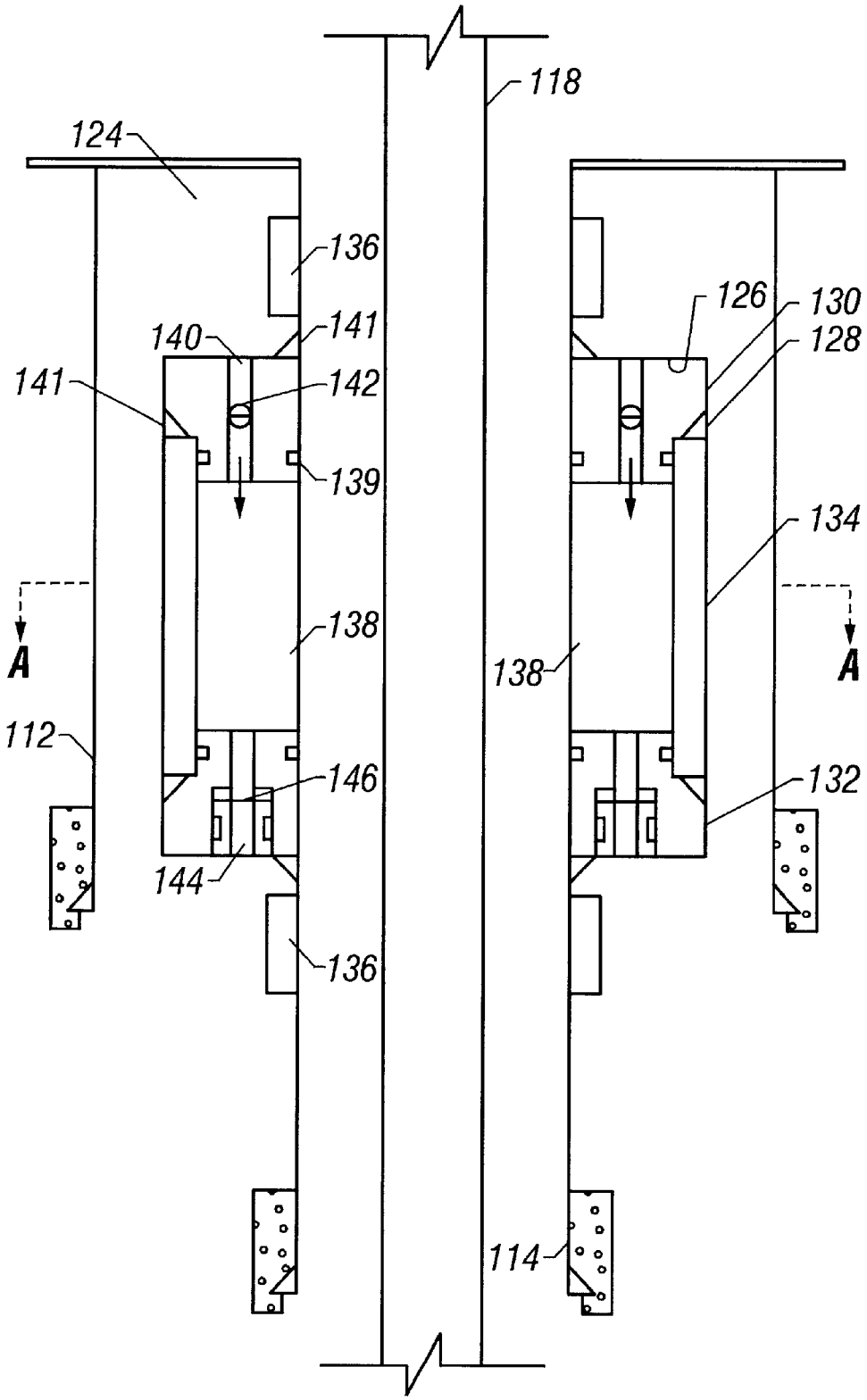
FIG. 3A is a cross-sectional view of the pressure relief device of FIG. 2 disposed between two casings.
Figure 3B:
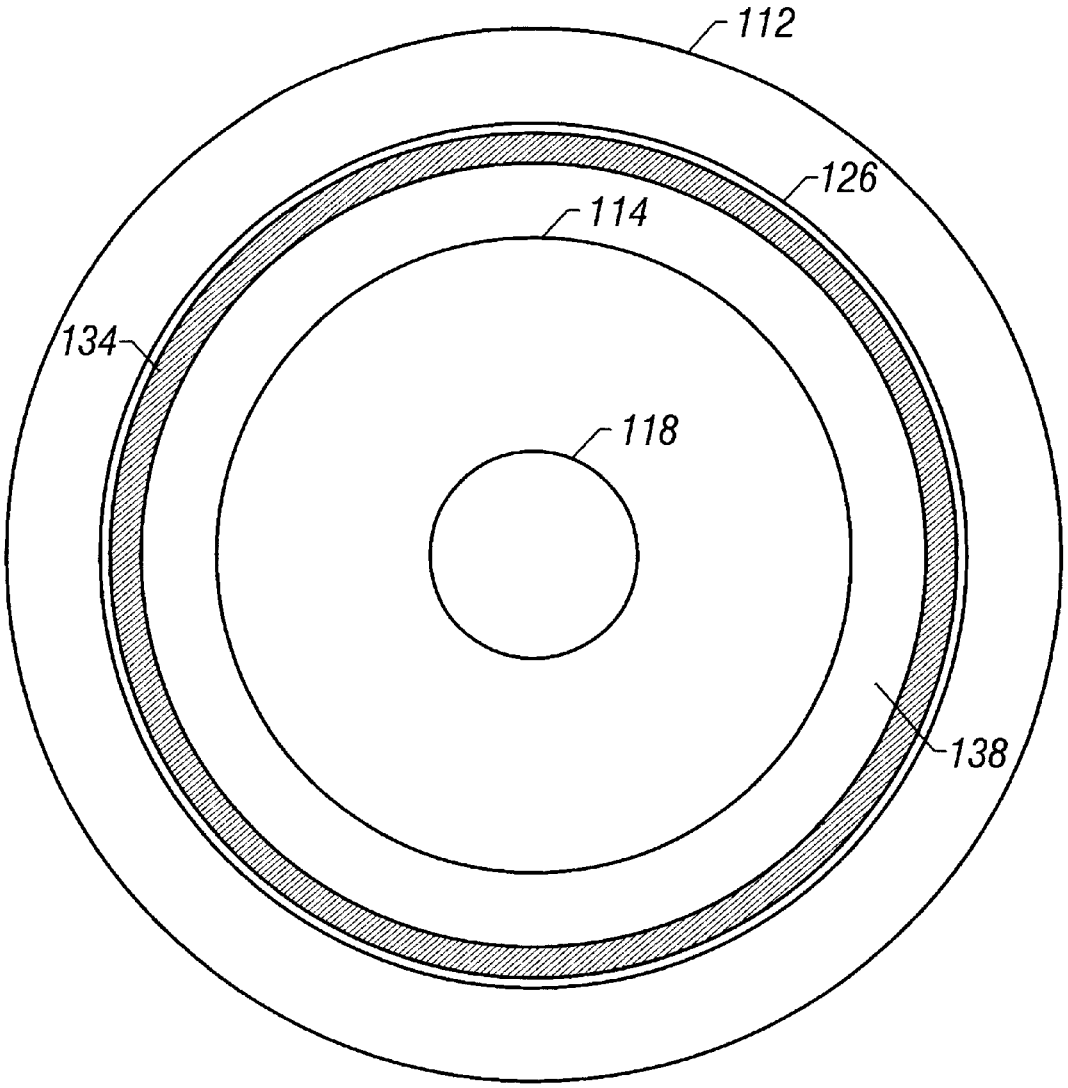
FIG. 3B is a cross-sectional view of FIG. 3A along line A—A.

Referring to FIGS. 3A and 3B, the pressure relief device 128 defines a chamber 126 in the annular space 124. The pressure relief device 128 comprises a first end cap 130, a second end cap 132, and an annular housing 134 extending between the end caps 130 and 132. The end caps 130 and 132 are mounted on a joint of the casing 114. Casings are made of multiple joints that are linked together by casing couplings 136. The casing 114, the end caps 130 and 132, and the annular housing 134 define a cavity or fluid dump chamber 138. The fluid dump chamber 138 is arranged to receive fluid from the annular space 124 when the pressure of the fluid trapped in the annular space 124 reaches a predetermined pressure. Seal members 139 provide pressure seals between the end caps 130 and 132 and the casing 114 and between the end caps 130 and 132 and the annular housing 134. Alternatively, the fluid dump chamber 138 can be made fluid-tight by welding the end caps 130 and 132 to the casing 114 and welding the annular housing 134 to the end caps, as shown at 141. Although the pressure relief device 128 is shown as mounted on the casing 114, it should be clear that the pressure relief device 128 may also be mounted on the casing 112.

The end cap 130 includes a port 140 which allows fluid communication between the annular space 124 and the fluid dump chamber 138 when the pressure in the annular space 124 reaches a predetermined pressure. A pressure relief valve 142 is disposed in the port 140 to control fluid communication between the annular space 124 and the fluid dump chamber 138. The pressure relief valve 142 may be selected to open when the pressure in the annular space reaches the predetermined pressure. This predetermined pressure may be selected as the design pressure of the casing 114 or 112 less a factor of safety. The end cap 130 may include multiple ports 140 and pressure relief valves 142 may be disposed in each port. The end cap 132 includes a port 144 which may also permit fluid communication between the annular space 124 and the fluid dump chamber 138 when the pressure in the annular space 124 reaches a predetermined pressure. A pressure vent device, e.g., rupture disc 146, is disposed in the port 144. The rupture disc 146 is arranged to burst to allow fluid in the annular space 124 to enter the fluid dump chamber 138 if the pressure in the annular space 124 reaches the disc burst pressure. Typically, the pressure in the annular space 124 will only reach the disc burst pressure if the pressure relief valve 142 fails. The end cap 132 may also have multiple flow ports similar to port 144 and pressure vent devices may be disposed in the flow ports.

In operation, when formation fluid starts to flow from the production zone 104 into the production casing 114, the temperature of the drilling fluid trapped in the annular space 124 starts to increase to the temperature of the flowing formation fluid. As the temperature of the drilling fluid increases, the trapped drilling fluid starts to expand and the pressure in the annular space 124 increases. When the pressure in the annular space 124 reaches a predetermined value, the drilling fluid starts to flow into the fluid dump chamber 138 until the pressure in the annular space 124 drops below the predetermined value. The fluid trapped in the annular spaces 122, shown in FIG. 2, also experience a similar pressure rise due to thermal expansion. Therefore, it should be clear that pressure relief devices, similar to the pressure relief device 128, may be disposed in the annular spaces 122 to stop pressure rise due to thermal expansion of trapped fluid. The fluid dump chamber 138 thus provides a variable "available annulus volume" because the opening of the pressure relief valve 142 increases the volume in the annulus available for the annulus fluid.

Figure 4:
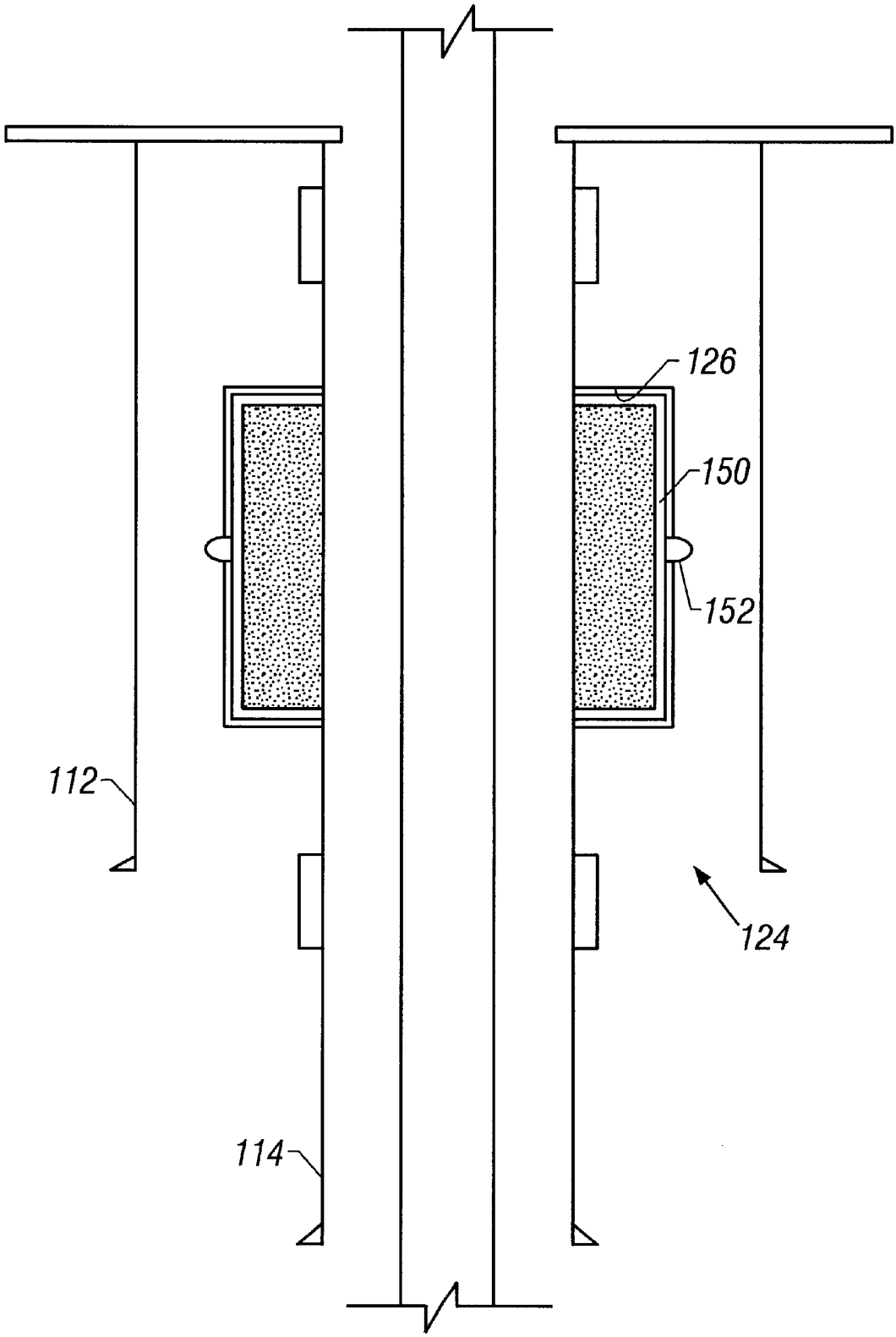
FIG. 4 shows a collapsible pressure relief device disposed between two casings.

The invention is not limited to the pressure relief device 128 having a fluid dump chamber 138 for receiving fluid from the annular space 124. FIG. 4 shows an alternate pressure relief device 150 that collapses to define a fluid dump chamber. The pressure relief device 150 is a collapsible air bladder that is secured to the casing 114 by a strap 152. Of course, other suitable means of securing the bladder to the casing 114 may be used. The bladder 150 is configured to collapse when the fluid trapped in the annular space 124 expands and the pressure in the annular space reaches a predetermined pressure. Like the pressure relief device 128 of FIG. 3A, the pressure relief device 150 also defines a chamber 126 in the annular space 124. As the bladder 150 collapses, a fluid dump chamber is created within the chamber 126 to receive fluid from the annular space 124.

Although the pressure relief device 150 is shown as an air bladder, it should be clear that other embodiments of a collapsing pressure relief device are possible. The collapsing pressure relief device is referred to generally herein as a variable volume body because it changes in shape to provide additional volume in the annulus. The changes in shape provide a change in the "available annulus volume" or volume of the annulus available for fluid within the annulus. As the fluid expands, the variable volume body contacts changing the available annulus volume. In an alternate embodiment, the pressure relief device may be a housing, e.g., cylinder, that is made of collapsible material, such as plastic foam. The cylinder may be secured to the casing 112 by a strap or any other suitable means, e.g., welding. The collapsible material is selected such that the cylinder collapses when the fluid trapped in the annular space expands and the pressure in the annular space 124 reaches a predetermined pressure. Like the air bladder, the collapsing cylinder will create a fluid dump chamber within the chamber 126 to receive excess fluid due to thermal expansion from the annular space 124. The air bladder or collapsible cylinder should be designed to have a larger volume than the expected volume increase in fluid due to thermal expansion.

Figure 5:
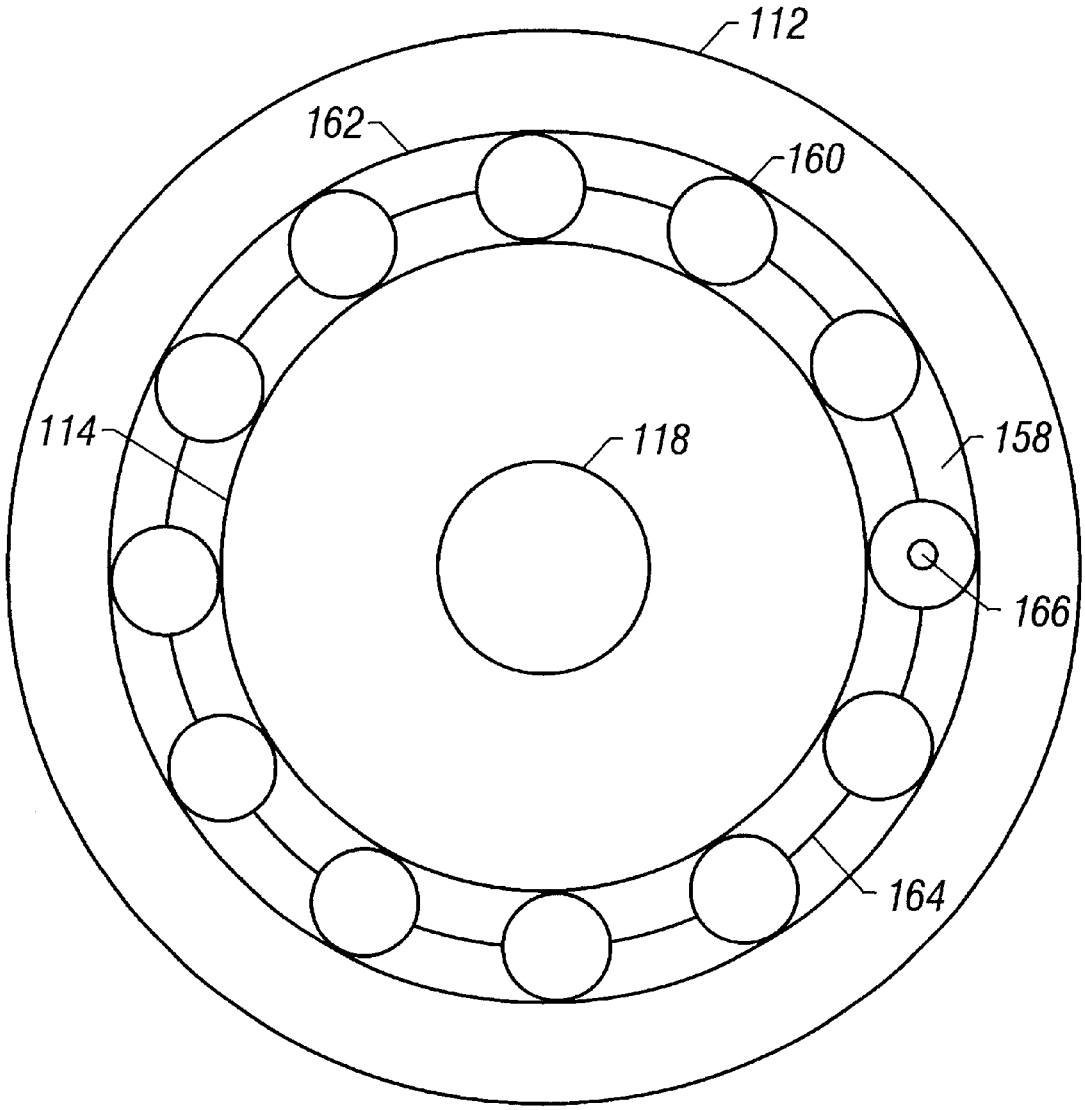
FIG. 5 shows a pressure relief device with a plurality of cavities disposed between two casings.

Referring to FIG. 5, another pressure relief device 158 is shown. The pressure relief device 158 defines a chamber 126 in the annular space 124. The pressure relief device 158 includes a plurality of vessels 160 which are secured to the casing 114 by a strap 162. Of course, other means of securing the vessels to the casing may also be used. The vessels 160 define fluid dump chambers which are linked together by a tubing 164. One of the vessels has end caps with flow ports that permit communication between the annular space 124 and the fluid dump chambers defined within the vessels. As in the pressure relief device 128 shown in FIG. 3A, a pressure relief valve and a rupture disc are disposed in the flow ports 166 to control fluid flow from the annular space 124 to the fluid dump chambers.

The invention has many advantages. First by employing the pressure relief device in the annular space, the pressure of the drilling fluid in the annular space can be limited to a desired pressure. If this desired pressure is less than the casing design pressure, then the possibility of bursting the casing is eliminated. This makes it unnecessary to use heavy-weight casing. A light-weight casing will result in substantial cost savings in the casing program. Second, the pressure relief device is run into the annular space between two casings. Thus, a possible leak path between casings is not created. Third, the pressure relief device is easy to install and is run into the well on the casing.

While the invention has been described with respect to a limited number of embodiments, those skilled in the art will appreciate numerous variations therefrom without departing from the spirit and scope of the invention. Any means of creating a fluid dump chamber within an annular space between two casings may be used with the invention. The fluid dump chamber will receive fluid from the annular space when the pressure in the annular space exceeds a predetermined pressure. In this way, the annular space can be maintained at a desired, safe pressure.

What is claimed is:

1. A system, comprising:

two well casings;

a closed space having fluid trapped therein, the closed space defined between the two casings;

a chamber defined in the closed space; and a pressure responsive member for controlling fluid flow from the closed space to the chamber;

wherein fluid flows from the closed space to the chamber when pressure in the closed space exceeds a first predetermined pressure.

2. The system of claim 1, wherein the pressure responsive member is mounted on one of the casings and comprises a housing with end caps, the housing, end caps, and the casing defining a cavity within the chamber.

3. The system of claim 2, wherein the cavity is connected to the closed space through a port.

4. The system of claim 3, wherein the pressure responsive member comprises a valve coupled to the port to control fluid flow from the closed space to the cavity.

5. The system of claim 4, wherein the valve is a pressure relief valve.

6. The system of claim 3, wherein the cavity is further connected to the closed space through a second port.

7. The system of claim 6, wherein the pressure responsive member comprises a pressure vent device coupled to the second port to control fluid from the closed space to the cavity.

8. The system of claim 7, wherein the pressure vent device is a rupture disc, the rupture disc being configured to burst when the pressure in the closed space reaches a second predetermined pressure.

9. The system of claim 8, wherein the second predetermined pressure is higher than the first predetermined pressure.

10. The system of claim 1, wherein the pressure responsive member collapses to define a cavity within the chamber when the pressure in the closed space reaches the first predetermined pressure.

11. The system of claim 10, wherein the pressure responsive member is an air bladder.

12. The system of claim 10, wherein the pressure responsive member is a cylinder made of collapsible material.

13. The system of claim 1, wherein the volume of the chamber is at least equal to the increase in volume expected in the closed space due to thermal expansion of the fluid trapped in the closed space.

14. The system of claim 1, wherein the first predetermined pressure is less than the maximum design pressure of the casings.

15. A pressure relief system, comprising:

a closed space having fluid trapped therein;

a chamber defined in the closed space; and a pressure responsive member for controlling fluid flow from the closed space to the chamber;

wherein fluid flows from the closed space to the chamber when pressure in the closed space exceeds a first predetermined pressure, wherein the pressure responsive member comprises a plurality of interconnected cavities disposed within the chamber and wherein the cavities are connected to receive fluid from the closed space when the pressure in the closed space reaches the first predetermined pressure.

16. A method for relieving pressure in a closed space having fluid trapped therein, comprising:

providing a chamber in the closed space for receiving fluid from the closed space defined outside a well casing; and providing a pressure responsive member for controlling fluid communication between the closed space and the chamber.

17. The method of claim 16, wherein providing a pressure responsive member comprises configuring a first portion of the pressure responsive member to permit fluid flow from the closed space to the chamber when the pressure in the closed space reaches a first predetermined pressure.

18. The method of claim 17, wherein providing a pressure responsive member comprises configuring a second portion of the pressure responsive member to permit fluid flow from the closed space to the chamber when the pressure in the closed space reaches a second, larger predetermined pressure.

19. The method of claim 16, wherein providing the chamber comprises providing the chamber for receiving fluid from the closed space defined between the well casing and a second well casing.

20. A well conduit pressure relief system for use in a well, comprising:

a casing disposed in the well;

the well and the casing defining an annulus therebetween;

at least one variable volume body disposed within the annulus and adapted to collapse in response to a rise in pressure in the annulus.

21. A system for use in a well, comprising:

a first casing adapted to be disposed in the well so that a closed space is defined outside the casing;

a pressure relief apparatus adapted to communicate with the closed space; and a chamber, the pressure relief apparatus adapted to communicate trapped fluid in the closed space into the chamber in response to pressure within the closed space being at or greater than a predetermined pressure.

22. The system of claim 21, further comprising a second casing, the first and second casings arranged to define the closed space.

23. The system of claim 21, wherein the pressure relief apparatus comprises:

a first portion adapted to permit fluid flow from the closed space in response to pressure within the closed space reaching a first predetermined pressure; and a second portion adapted to permit fluid flow from the closed space in response to pressure within the closed space reaching a second, larger predetermined pressure.

24. The system of claim 23, wherein the first portion comprises a valve.

25. The system of claim 24, wherein the second portion comprises a rupture element.

26. The system of claim 21, wherein the pressure relief apparatus comprises a collapsible element adapted to collapse when the pressure within the closed space is at or greater than the predetermined pressure.

27. The system of claim 26, wherein the collapsible element comprises a collapsible air bladder.

28. A method of controlling pressure in an annulus region defined outside a well casing, comprising:

providing a chamber;

actuating a pressure relief mechanism in response to pressure in the annulus region being at or greater than a predetermined pressure; and communicating fluid from the annulus region outside the well casing to the chamber when the pressure relief mechanism is actuated.

29. The method of claim 28, wherein communicating the fluid comprises communicating fluid from the annulus region defined between the well casing and a second well casing.

30. The method of claim 28, wherein actuating the pressure relief mechanism comprises actuating a first portion of the pressure relief mechanism when the pressure in the annulus region reaches a first predetermined pressure.

31. The method of claim 30, wherein actuating the pressure relief mechanism comprises actuating a second portion of the pressure relief mechanism when the pressure in the annulus region reaches a second predetermined pressure.

32. The method of claim 31, wherein actuating the first portion comprises actuating a valve.

33. The method of claim 32, wherein actuating the second portion comprises actuating a rupture element.

34. A system for relieving pressure from a closed space in a well, comprising:

a fluid dump chamber; and a pressure relief apparatus in communication with the fluid dump chamber, the pressure relief apparatus comprising:

a first fluid communications element adapted to communicate fluid flow from the closed space to the fluid dump chamber, the first fluid communications element adapted to be responsive to a first predetermined pressure in the closed space; and a second fluid communications element adapted to communicate fluid flow from the closed space to the fluid dump chamber, the second fluid communications element adapted to be responsive to a second, greater predetermined pressure in the closed space.

35. The system of claim 34, wherein the first fluid communications element comprises a valve.

36. The system of claim 35, wherein the second fluid communications element comprises a rupture element.

37. The system of claim 34, wherein the pressure relief apparatus is adapted to communicate with the closed space defined between two well casings.

38. A system for relieving pressure from a closed space in a well, comprising:

a fluid dump chamber; and a collapsible element disposed in the fluid dump chamber, the collapsible element adapted to collapse in response to pressure in the closed space reaching a predetermined level to provide an increased volume to accept fluid from the closed space into the fluid dump chamber.

39. The system of claim 38, wherein the collapsible element comprises a collapsible air bladder.

* * * * *